US008065955B2

(12) United States Patent
Braun

(10) Patent No.: US 8,065,955 B2
(45) Date of Patent: Nov. 29, 2011

(54) HYDRAULIC PRESS

(75) Inventor: Stephen J. Braun, Marysville, OH (US)

(73) Assignee: Honda Motor Company, Ltd., Tokyo (JP)

( * ) Notice: Subject to any disclaimer, the term of this patent is extended or adjusted under 35 U.S.C. 154(b) by 399 days.

(21) Appl. No.: 12/326,496

(22) Filed: Dec. 2, 2008

(65) Prior Publication Data

US 2010/0132428 A1 Jun. 3, 2010

(51) Int. Cl.
*B30B 15/00* (2006.01)

(52) U.S. Cl. ..... 100/257; 100/269.17; 100/349; 72/455

(58) Field of Classification Search ..... 100/214, 100/219, 257, 269.01, 269.17, 349; 72/455; 29/251
See application file for complete search history.

(56) References Cited

U.S. PATENT DOCUMENTS 1,571,622 A * 2/1926 Briggs ..... 100/257
1,650,818 A * 11/1927 Buffington et al. ..... 29/251
1,758,451 A * 5/1930 Manley ..... 248/422
2,361,491 A 10/1944 Nagin
2,389,821 A 11/1945 Shealy
2,454,856 A 11/1948 Bible
3,756,058 A 9/1973 Hamkins et al.
3,789,757 A 2/1974 Motter et al.
4,087,112 A 5/1978 Lee, Jr.
4,169,412 A * 10/1979 Stelmasik et al. ..... 100/257
4,176,151 A 11/1979 Suzuki
4,197,795 A * 4/1980 Hawkins ..... 100/257
4,457,684 A 7/1984 Gram
4,527,684 A 7/1985 Eggeman et al.
4,671,528 A 6/1987 Thompson
4,773,805 A 9/1988 Krahling
5,394,948 A 3/1995 Bunnell
6,872,039 B2 3/2005 Baus et al.
7,226,040 B2 * 6/2007 Keister ..... 254/324
2008/0206010 A1 * 8/2008 Fa-Kouri ..... 410/100

* cited by examiner

*Primary Examiner* — Jimmy T Nguyen
(74) *Attorney, Agent, or Firm* — Ulmer & Berne LLP

(57) ABSTRACT

A hydraulic press is provided that includes a frame having a base, an upper member positioned above the base and a pair of laterally spaced side members extending upwardly from the base to the upper member. The hydraulic press also includes a cross-member extending between the pair of side members, with the cross-member being configured to support a work piece and moveable along the side members.

21 Claims, 5 Drawing Sheets

HYDRAULIC PRESS

TECHNICAL FIELD

The present invention is related to hydraulic presses.

BACKGROUND

Conventional hydraulic presses include those having a stationary frame and a member that is moveable relative to the frame and is configured to support a work piece. The moveable work-piece-support member is typically restrained from downward movement during operation of the press by one or more pins that are positioned below the support member, with each pin extending through one of the side members of the frame. The work-piece-support member is supported by the pin(s) during operation of the press.

The pins typically include a blunt distal end that can be somewhat difficult for the press operator to insert through apertures formed in the frame. Also, the configuration of the proximal end, typically a cylindrical rod, may not facilitate a secure or comfortable grasp of the pin by an operator.

It can be necessary to relocate the moveable work-piece-support member in a generally vertical direction relative to the frame between operations of the press to accommodate work pieces having different shapes and/or sizes. If the support member must be relocated downward, the pin(s) positioned below the support member must be removed. In certain conventional hydraulic presses, when the pin(s) are removed, the press operator must continuously support the work-piece-support member to prevent it from free-falling downward.

SUMMARY

According to one embodiment, a hydraulic press is provided that includes a frame having a base, an upper member positioned above the base and a pair of laterally spaced side members extending upwardly from the base to the upper member. The hydraulic press also includes a cross-member extending between the pair of side members. The cross-member is configured to support a work piece and is moveable along the side members. The hydraulic press further includes a strap connected to the upper member of the frame and the cross-member.

According to another embodiment, a hydraulic press is provided that includes a frame having a base, an upper member positioned above the base and a pair of laterally spaced side members extending upwardly from the base to the upper member. The hydraulic press also includes a cross-member extending between the pair of side members. The cross-member is configured to support a work piece. The hydraulic press further includes a retention member connected to the upper member and the cross-member, and a pin engaged with one of the side members. The pin is positioned below and in contacting engagement with the cross-member.

According to another embodiment, a hydraulic press is provided that includes a frame having a base, an upper member positioned above the base and a pair of laterally spaced side members extending upwardly from the base to the upper member. The hydraulic press further includes a cross-member extending between the pair of side members. The cross-member is configured to support a work piece. The cross-member is constrained from movement in a downward direction during operation of the hydraulic press and is moveable in at least one of an upward direction and a downward direction along the side members when the hydraulic press is not in operation. The hydraulic press further includes a strap connected to the upper member of the frame and the cross-member.

A pin is provided for use in a hydraulic press. According to one embodiment, a pin includes a handle, a tapered tip and an intermediate portion extending between the handle and the tapered tip. The handle includes a grip and a shield extending radially outwardly from the grip. The shield is located proximate the intermediate portion of the handle. The pin further includes a sheath secured to the intermediate portion of the pin. The sheath is made from an elastomeric material.

BRIEF DESCRIPTION OF THE DRAWINGS

Various embodiments according to the inventive principles will become better understood with regard to the following description, appended claims and accompanying drawings wherein:

DETAILED DESCRIPTION

Figure 1:
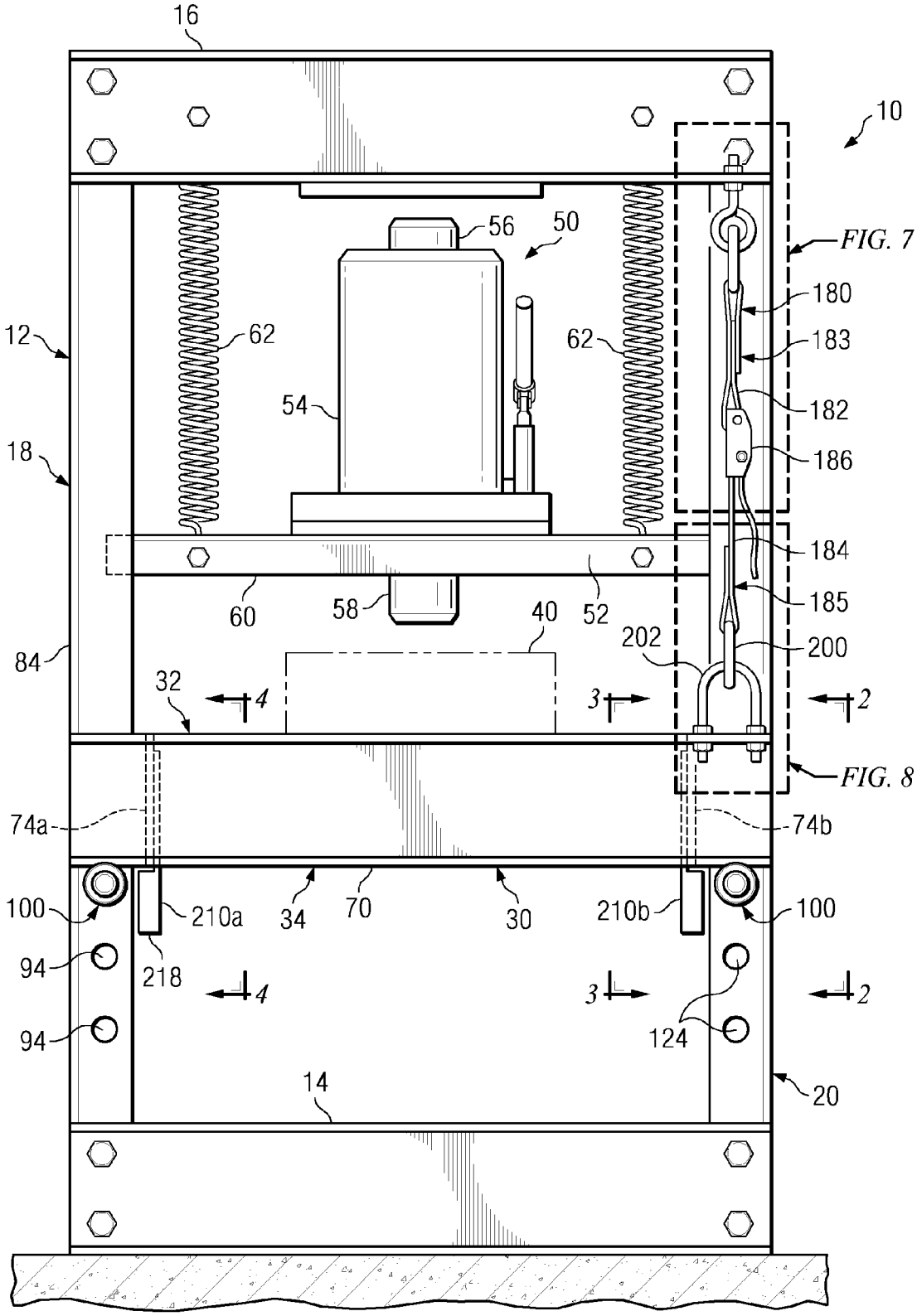
FIG. 1 is a front elevation view of a hydraulic press according to one embodiment.

FIG. 1 illustrates a hydraulic press 10 according to one embodiment. Hydraulic press 10 includes a frame 12 that can include a base 14, an upper member 16 positioned above base 14, a first side member 18 and a second side member 20. The first 18 and second 20 side members extend upwardly from base 14 to upper member 16. Base 14, upper member 16 and side members 18, 20 can be made of various metals, for example steel, and the side members 18, 20 can be secured to both the base 14 and upper member 16 by welding or using any other suitable means, for example by using brackets and/or fasteners.

Hydraulic press 10 also includes a cross-member 30 that extends between side members 18, 20 and is moveable along side members 18, 20 in both a generally vertical upward direction and a generally vertical downward direction. However, when press 10 is in operation, cross-member 30 is constrained from moving downward below a predetermined operating location relative to frame 12, for example that shown in FIG. 1, which can vary with application of hydraulic press 10 as subsequently described. Cross-member 30 can also be constrained from moving downward below a predetermined location relative to frame 12 when hydraulic press 10 is not in operation.

Cross-member 30 includes a top 32 and a bottom 34. Top 32 is configured to support a work piece indicated schematically at 40. Hydraulic press 10 can include a hydraulic sub-assembly 50 that is effective for engaging work piece 40, and performing work on work piece 40, during operation of hydraulic press 10. The hydraulic sub-assembly 50 can include a platform 52 that is positioned vertically between the upper member 16 and cross-member 30. Platform 52 is moveable along the side members 18, 20 in both a generally vertical downward direction and a generally vertical upward direction. Hydraulic sub-assembly 50 includes a housing 54 supported by platform 52. When hydraulic fluid within housing 54 is sufficiently pressurized, a piston 56 is extended upward until it contacts the upper member 16. The reaction force causes platform 52 to move downward. A work-piece-engaging member 58 is fixedly secured to a bottom 60 of platform 52. The spacing between platform 52 and cross-member 30, as well as the length of piston 56 and work-piece-engaging member 58 are selected so that member 58 can engage work piece 40 during operation of press 10. When hydraulic pressure is released, platform 52 and work-piece-engaging member 58 can move upward away from work piece 40 under the action of resilient members 62, which can be coil springs as shown in FIG. 1. Resilient members 62 can extend between and be secured to upper member 16 and platform 52. In other embodiments, press 10 can include a hydraulic sub-assembly having a configuration different than the configuration of sub-assembly 50 and can include other types of sub-assemblies, for example, a sub-assembly utilizing pneumatic rather than hydraulic pressure. The features and operation of hydraulic sub-assemblies, such as sub-assembly 50, are known in the art and will not be described further herein.

Figure 2:
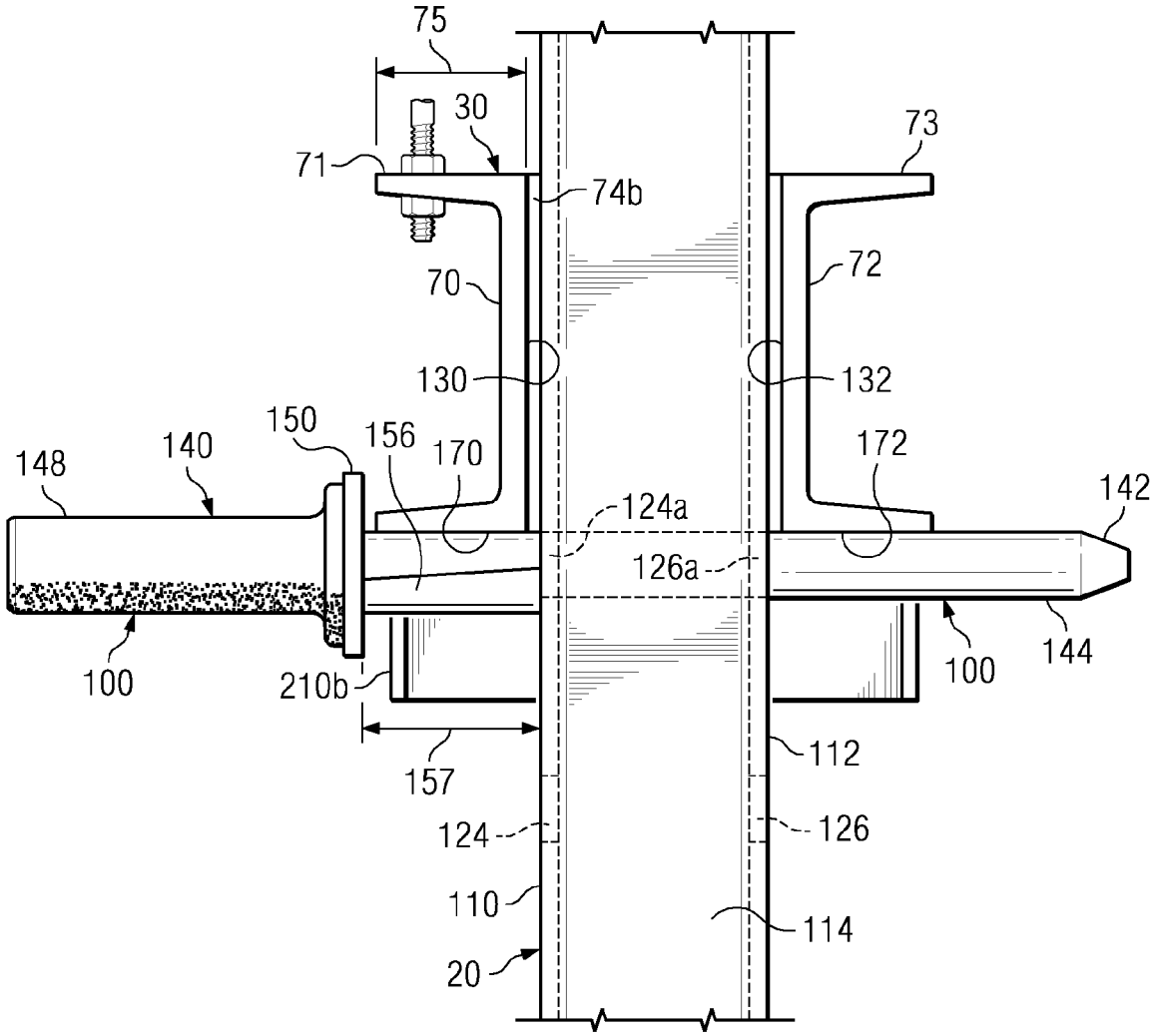
FIG. 2 is a side elevation view taken along line 2-2 in FIG. 1.
Figure 3:
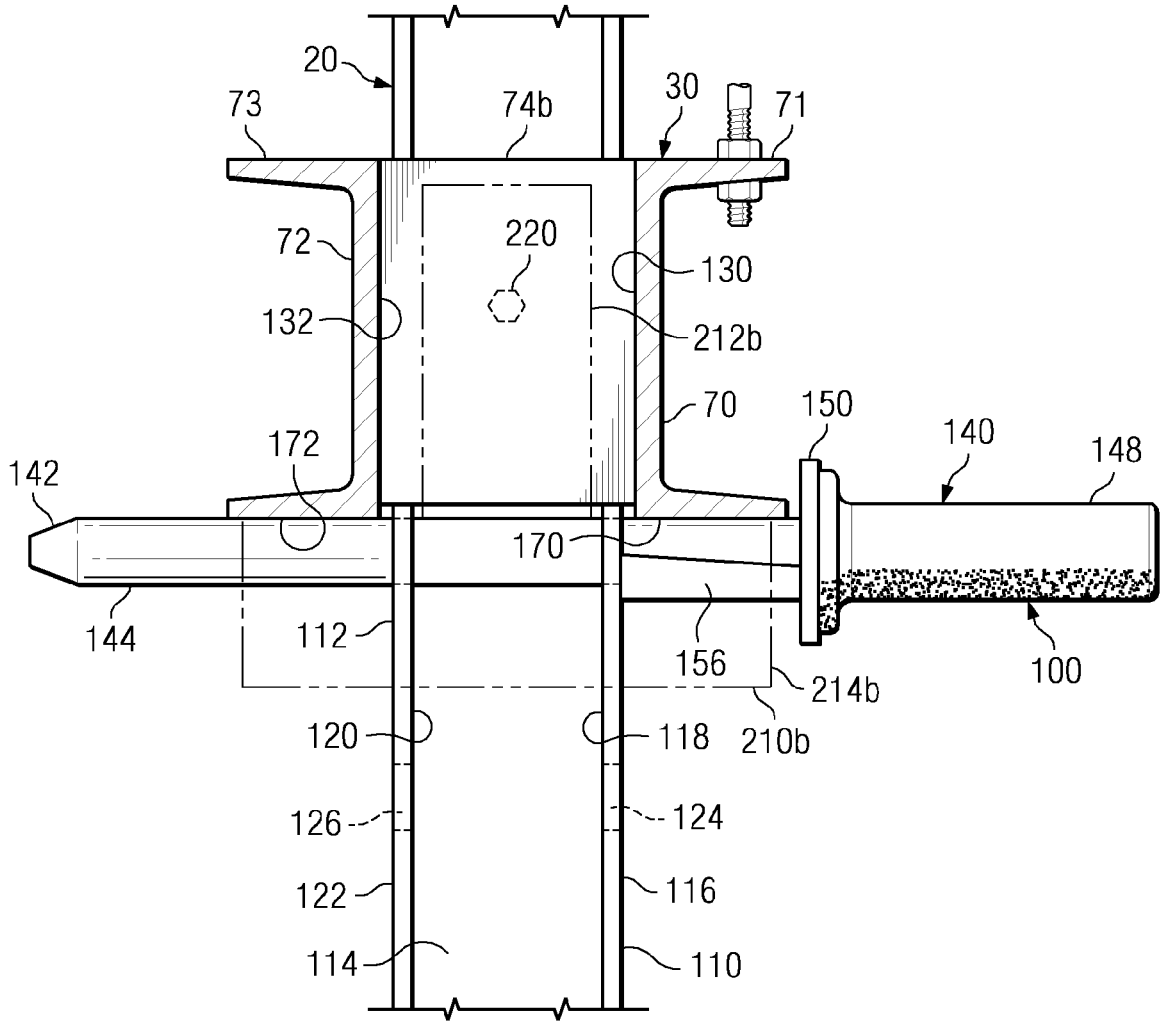
FIG. 3 is a cross-sectional view taken along line 3-3 in FIG. 1, with one of the hand guards shown in dashed lines for clarity of illustration.
Figure 4:
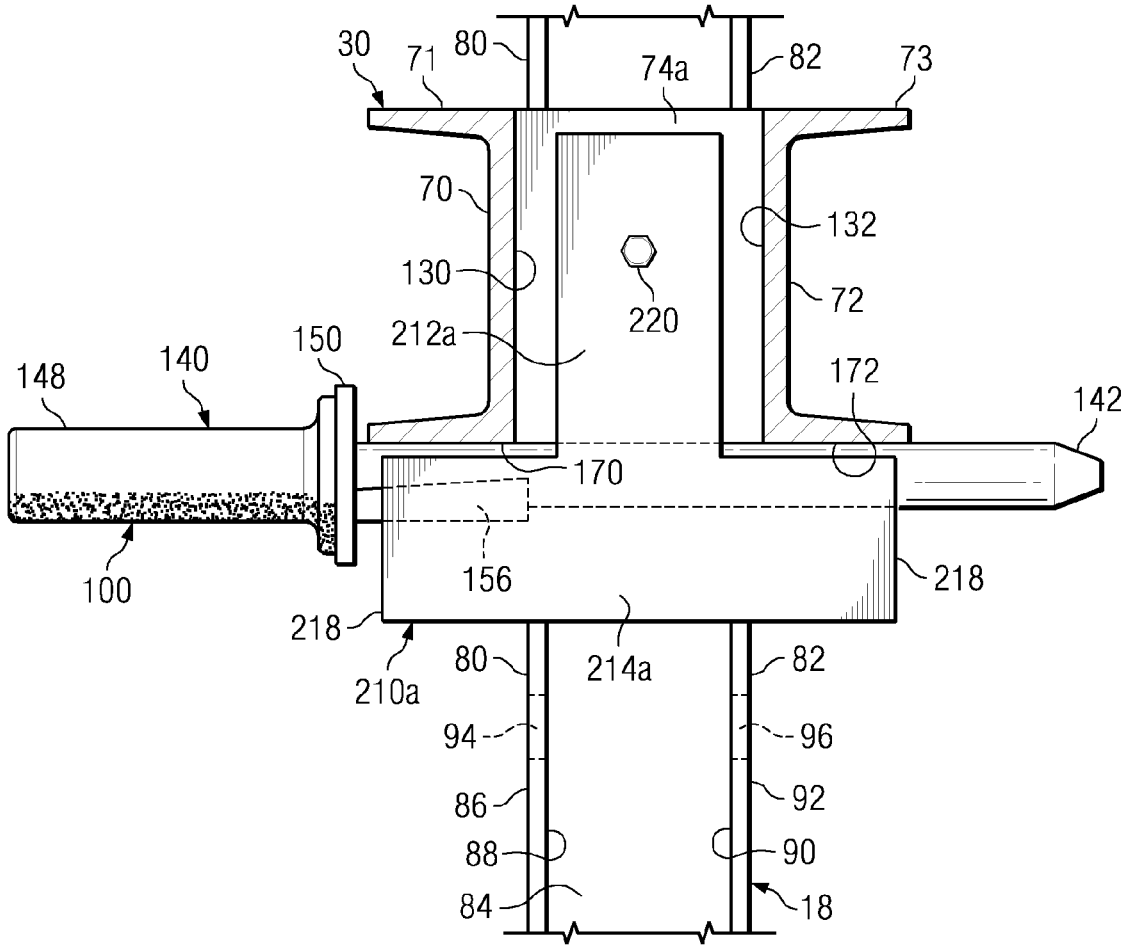
FIG. 4 is a cross-sectional view taken along line 4-4 in FIG. 1.

As shown in FIGS. 2-4, cross-member 30 can include a first beam 70 and a second beam 72. Beam 70 includes a top surface 71 and beam 72 includes a top surface 73 that can cooperate to support work piece 40. The top 32 of cross-member 30 can include surfaces 71 and 73. Each of the beams 70 and 72 can have a generally C-shaped cross-section, or other shapes that are suitable for supporting work piece 40. For example, one or both of the beams 70 and 72 can have generally square or generally rectangular cross-sectional shapes. Each of the beams 70 and 72 extend between side members 18 and 20 and each of the beams 70 and 72 can be generally horizontally oriented. Cross-member 30 can also include web members 74*a* and 74*b* that extend between beams 70 and 72 and are secured, for example by welding, to each of the beams 70 and 72. As shown in FIG. 1, web member 74*a* can be positioned proximate side member 18 and web member 74*b* can be positioned proximate the side member 20. In one embodiment, beams 70, 72 and web members 74*a*, 74*b* can be a unitary structure.

As shown in FIG. 4, side member 18 can include a front end wall 80, a rear end wall 82, and a side wall 84 extending between the front 80 and rear 82 end walls. Front end wall 80 has a front surface 86, which can be a front surface of side member 18, and a rear surface 88. Rear end wall 82 has a front surface 90 and a rear surface 92, which can be a rear surface of side member 18. Side member 18 can further include a first plurality of vertically spaced apertures 94 that extend through the first end wall 80 and a second plurality of vertically spaced apertures 96 (one shown) that extend through the second end wall 82. Each of the apertures 94 can be aligned with a respective one of the apertures 96. Apertures 94, 96 are configured to receive a pin 100 that can extend through side member 18.

Similarly, as shown in FIGS. 2 and 3, side member 20 can include a front end wall 110, a rear end wall 112, and a side wall 114 extending between the front 110 and rear 112 end walls. Front end wall 110 has a front surface 116, which can be a front surface of side member 20, and a rear surface 118. Rear end wall 112 has a front surface 120 and a rear surface 122, which can be a rear surface of side member 20. Side member 20 can further include a first plurality of vertically spaced apertures 124 that extend through the first end wall 110 and a second plurality of vertically spaced apertures 126 that extend through the second end wall 112. Each of the apertures 124 can be aligned with a respective one of the apertures 126. Apertures 124, 126 are also configured to receive pin 100. Hydraulic press 10 can include two of the pins 100. A first one of the pins 100 can be engaged with and extend through side member 18 of frame 12 as shown in FIGS. 1 and 4 and a second one of the pins 100 can be engaged with and extend through side member 20 as shown in FIGS. 1-3.

Beam 70 of cross-member 30 includes a rear surface 130 and beam 72 of cross-member 30 includes a front surface 132. Web members 74*a* and 74*b* of cross-member 30 can have the same configuration and can be sized so that the rear surface 130 of beam 70 is proximate the front surface 86 of side member 18 (FIG. 4), at one end of beam 70, and the rear surface 130 of beam 70 is proximate the front surface 116 of side member 20 (FIG. 3), at an opposite end of beam 70. Similarly, the front surface 132 of beam 72 can be proximate the rear surface 92 of side member 18 (FIG. 4), at one end of beam 72, and can be proximate the rear surface 122 of side member 20 (FIG. 3), at an opposite end of beam 72.

Figure 5:
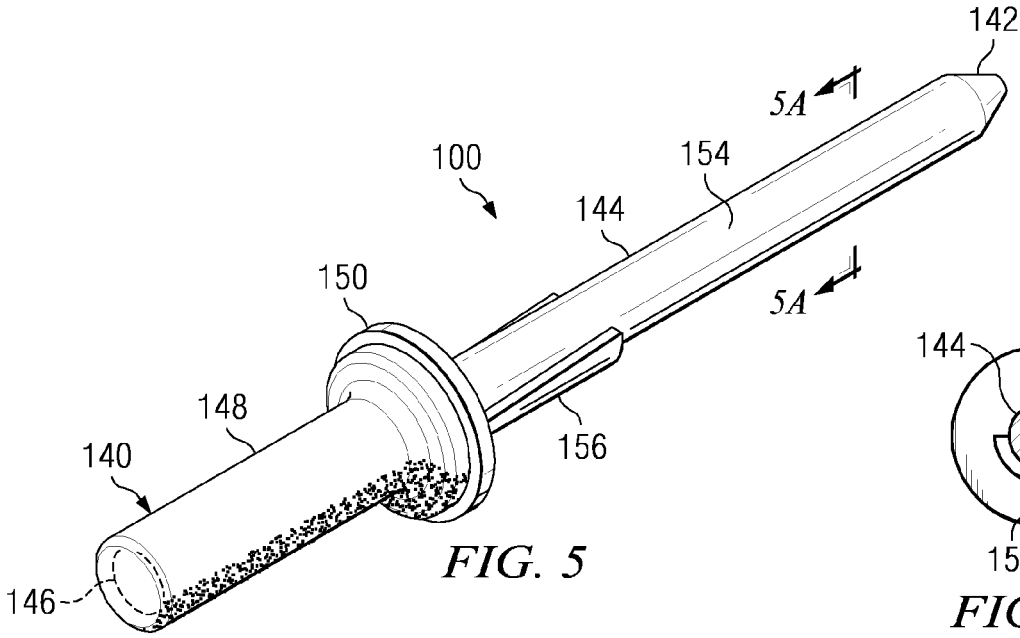
FIG. 5 is a perspective view of a pin according to one embodiment that can be included in the hydraulic press shown in FIG. 1.

As shown in FIG. 5, pin 100 can include a handle 140, a tapered tip 142 and an intermediate portion 144 extending between the handle 140 and the tapered tip 142. Handle 140 can include a core portion 146 and a grip 148 surrounding the core portion 146. The core portion 146 can be made from a metal or metal alloy and the grip 148 can be made from an elastomeric material, for example natural rubber or synthetic rubber, and can be secured to the core portion 146 using an adhesive or other conventional means. Handle 140 can also include a shield 150 that is integral with the grip 148 and extends radially outwardly from the grip 148. Shield 150 can be made from the same elastomeric material as grip 148.

Figure 5A:
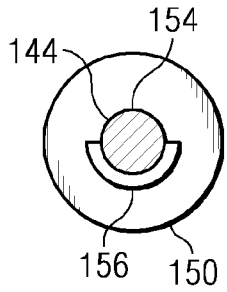
FIG. 5A is a cross-sectional view taken along line 5A-5A in FIG. 5.

The intermediate portion 144 of pin 100 can have a cylindrical outer surface 154. As shown in FIGS. 5 and 5A, pin 100 can further include a sheath 156 that is positioned proximate handle 140 and extends at least partially around the cylindrical outer surface 154 for at least a portion of the length of the intermediate portion 144 of pin 100. The sheath 156 can be made from an elastomeric material and can be secured to the intermediate portion 144 of pin 100 with an adhesive or by using other conventional means. The core portion 146 of handle 140 of pin 100, the intermediate portion 144 of pin 100 and the tapered tip 142 of pin 100 can be a unitary solid rod made from a metal, metal alloy or other material having suitable mechanical properties.

The relationship that can exist among pins 100, frame 12 and cross-member 30 will be described with respect to side member 20, the respective pin 100 and cross-member 30, but can also apply to side member 18, the respective pin 100 and cross-member 30. During operation of hydraulic press 10, at least one pin 100 is engaged with frame 12 of press 10 and at least a portion of the bottom 34 of cross-member 30 is engaged with each pin 100 that is engaged with frame 12. Pin 100 is sized to withstand the downward force exerted by cross-member 30 on the pin(s) 100 during operation of press 10, as a result of platform 52 of the hydraulic actuator sub-assembly 50 moving downward so that the work-piece-engaging member 58 contacts, and performs work on, work piece 40.

Pin 100 can extend through one of the apertures 124, identified as 124*a* in FIG. 2, formed in the front end wall 110 of side member 20 and an aligned one of the apertures 126, identified as 126*a*, formed in the rear end wall 112 of side member 20. Sheath 156 of pin 100 can function as an over-insertion stopper. In this regard, the intermediate portion 144 and the sheath 156 of pin 100 can be sized so that sheath 156 can not pass through apertures 124*a* and 126*a*, such that the sheath 156 can contact the front surface 116 of the front end wall 110 of side member 20, and a length 157 of sheath 156 can be sized so that length 157 is greater than a width 75 of beam 70 and shield 150 of pin 100 is spaced apart from beam 70, when sheath 156 contacts the front surface 116 of the front end wall 110 as shown in FIGS. 2-4. The bottom 34 of cross-member 30 can include a bottom surface 170 of beam 70 and a bottom surface 172 of beam 72. At least a portion of the bottom 34 of cross-member 30 can rest atop the pin 100. As shown in FIGS. 2 and 3, the bottom surface 170 of beam 70 and the bottom surface 172 of beam 72 can each engage the intermediate portion 144 of pin 100.

Hydraulic press 10 can further include a retention member 180 that can be connected to the upper member 16 of frame 12 and the cross-member 30 as shown in FIG. 1. Retention member 180 can be a strap, such as an adjustable strap. As shown in FIG. 1, retention member 180 can include a first flexible member 182, a second flexible member 184 and an adjustment device 186, which can be a buckle as shown in FIG. 1. Each of the flexible members 182, 184 can be connected to the adjustment device 186. The first 182 and second 184 flexible members can be made from a polymer, for example nylon webbing. Flexible members 182, 184 can also be made from other suitable material having comparable or superior tensile strength.

Figure 7:
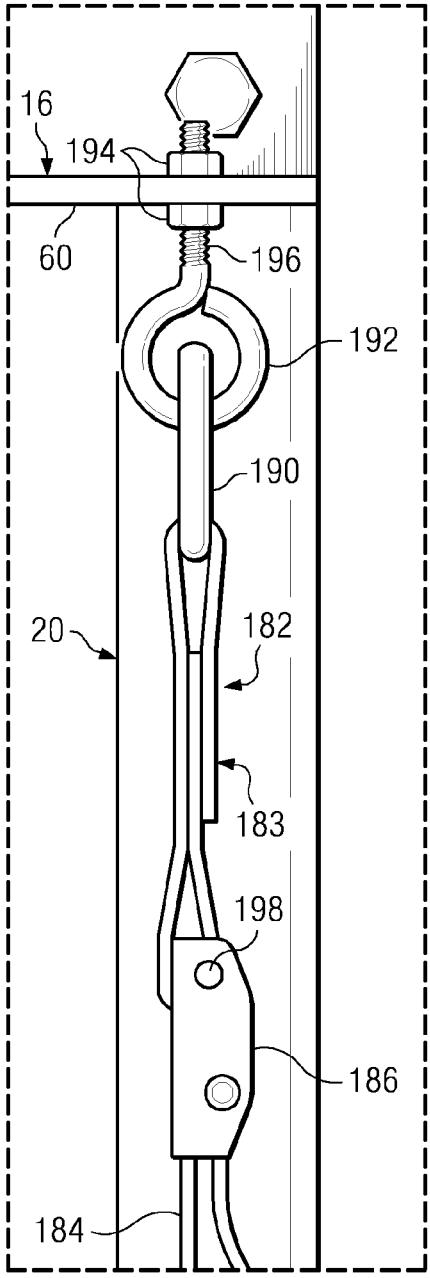
FIG. 7 is an enlarged view of an encircled area of the hydraulic press shown in FIG. 1.

Flexible member 182 can be connected to the upper member 16 of frame 12 and the flexible member 184 can be connected to the cross-member 30. Flexible member 182 can be connected to upper member 16 using a variety of connecting devices. In one embodiment, the flexible member 182 can be connected to a ring member 190 supported by an eye-bolt 192 that can be fastened to the upper member 16 of frame 14 as shown in FIG. 7 using nuts 194 that can threadably engage a threaded shank 196 of eye-bolt 192. The flexible member 182 can loop around a pin 198 of adjustment device 186. In other embodiments (not shown), flexible member 182 can be connected to upper member 16 using a bracket or other suitable device that is secured directly to upper member 16, for example by welding or using fasteners, and that includes an opening sufficiently large to receive flexible member 182. The ends of the first flexible member 182 can overlap one another, after connecting the flexible member 182 to upper member 16 and adjustment device 186, at location indicated generally at 183 as shown in FIG. 1. The two ends of flexible member 182 can be secured to one another and to an adjacent portion of the flexible member 182, which extends between ring member 190 and adjustment device 186, at location 183 by conventional means, for example sewing. As may be appreciated, the length of the flexible member 182 may be such that the opposite ends of flexible member 182 do not overlap.

Figure 8:
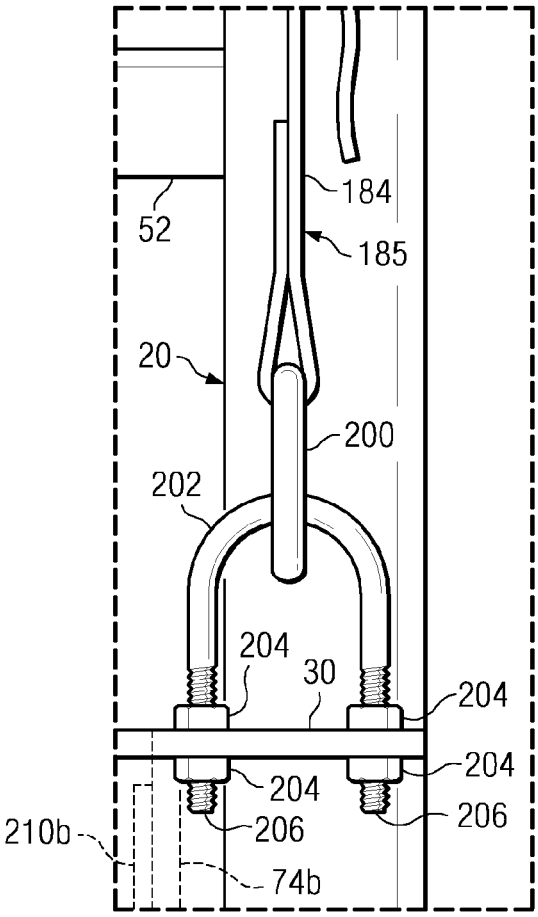
FIG. 8 is an enlarged view of an encircled area of the hydraulic press shown in FIG. 1.

The flexible member 184 can be connected to cross-member 30 using a variety of connecting devices. In one embodiment, flexible member 184 can be connected to cross-member 30 using ring member 200 and U-bolt 202 as shown in FIGS. 1 and 8. U-bolt 202 can be fastened to cross-member 30 using nuts 204 that threadably engage a pair of threaded ends 206 of U-bolt 204. Ring member 200 can be connected to the U-bolt 202. An upper end of the flexible member 184 can adjustably engage and extend through the adjustment device 186 in a manner in which a strap engages a conventional seatbelt. After passing a lower end of flexible member 184 through ring member 200, the lower end of flexible member 184 can be secured to an adjacent portion of flexible member 184 at a location indicated generally at 185 by conventional means, for example sewing the adjacent portions of flexible member 184 to one another. In other embodiments (not shown), the flexible member 184 can be connected to cross-member 30 by a bracket or other suitable device secured directly to cross-member 30, for example by welding or using fasteners, and that includes an opening sufficiently large to receive flexible member 184. In another embodiment (not shown) a single flexible member can be used, with an adjustment device, in lieu of flexible members 182, 184.

Figure 6:
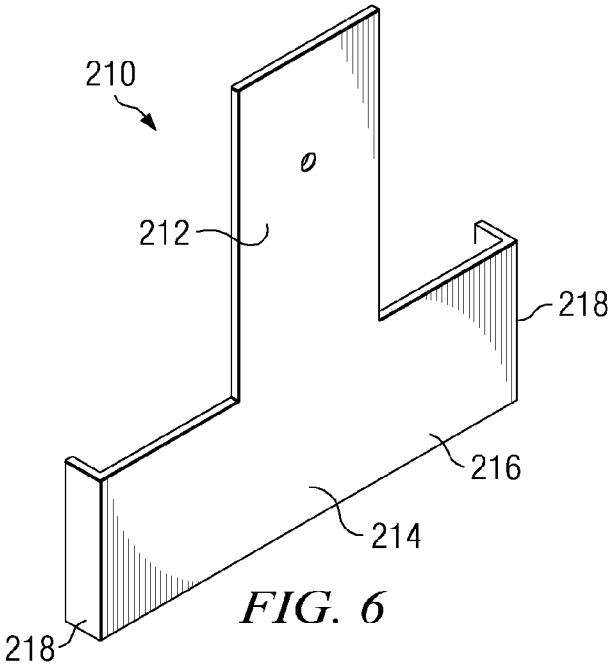
FIG. 6 is a perspective view of a hand guard according to one embodiment that can be included in the hydraulic press shown in FIG. 1.

The hydraulic press 10 can also include one or more hand guards 210. As shown in FIG. 6, each hand guard 210 can include a first portion 212 and a second portion 214 integral with the first portion 212. The first 212 and second 214 portions can be made as a unitary member. The first 212 and second 214 portions of hand guard 210 can be made from a metal, for example aluminum, a metal alloy, for example steel, or other suitable material. The second portion 214 of hand guard 210 can include a generally planar portion 216 and a pair of flanges 218. The flanges 218 can be integral with opposite ends of the generally planar portion 216 and can extend away from the generally planar portion 216.

The hydraulic press 10 can include a pair of hand guards, designated 210*a* and 210*b* in FIG. 1. As shown in FIG. 1, hand guard 210*a* can be secured to cross-member 30 at a location proximate side member 18 and hand guard 210*b* can be secured to cross-member 30 at a location proximate side member 20. As shown in FIG. 4, the first portion 212 of hand guard 210*a*, designated 212*a*, can be secured to the web member 74*a* of cross-member 30, which can be positioned proximate side member 18. Hand guard 210*a* can be secured to web member 74*a* using one or more conventional fasteners such as bolt 220 and a like number of nuts (not shown). In another embodiment, hand guard 210*a* can be secured to web member 74*a* using an adhesive, by welding hand guard 210*a* to web member 74*a* or by using other conventional means. The first portion 212*a* of hand guard 210*a* can be generally vertically oriented. The second portion 214 of hand guard 210*a*, designated 214*a*, can be positioned below cross-member 30 and can be generally horizontally oriented. The second portion 214*a* of hand guard 210*a* can be transverse to side member 18 and can extend beyond the front 86 and rear 92 surfaces of side member 18.

Referring to FIGS. 2 and 3, the first portion 212 of hand guard 210*b*, designated 212*b*, can be secured to the web member 74*b* of cross-member 30. Hand guard 210*b* is shown in dashed lines in FIG. 3 for clarity of illustration. Web member 74*b* can be positioned proximate side member 20 as shown in FIG. 1. Hand guard 210*b* can be secured to web member 74*b* using one or more conventional fasteners such as bolt 220 and a like number of nuts (not shown), or as otherwise described with respect to hand guard 210*a* and web member 74*a*. The first portion 212*b* of hand guard 210*b* can be generally vertically oriented. The second portion 214 of hand guard 210*b*, designated 214*b*, can be positioned below cross-member 30 and can be generally horizontally oriented. The second portion 214*b* of hand guard 210*b* can be transverse to side member 20 and can extend beyond the front 116 and rear 122 surfaces of side member 20. In other embodiments, hydraulic press 10 can include one or more hand guards that can each be configured for attachment to one or both of the beams 70 and 72 instead of a respective one of web members 74*a* and 74*b*.

In another embodiment, the handguard 210 and web member 74 can be made as a unitary member (not shown) having a first portion that is generally vertically oriented and a second portion that is generally horizontally oriented. The first portion can have a width that is substantially the same as a width of web member 74 such that the first portion can be secured, for example by welding, to each of the beams 70 and 72. The second portion of the unitary member can have the same configuration as portion 214 of handguard 210, or a different configuration provided that the unitary member can function as a handguard. One unitary member can be secured to beams 70 and 72 at a location proximate the side member 18 of frame 12, in lieu of web member 74*a* and handguard 210*a*, and another unitary member can be secured to beams 70 and 72 at a location proximate the side member 20 of frame 12.

During operation of hydraulic press 10, at least one of the pins 100 is engaged with frame 12. Typically, both of the pins 100 are engaged with frame 12 as described previously. When platform 52 is forced downward until work-piece-engaging member 58 contacts work piece 40, the force exerted on work piece 40 is reacted by the pins 100. Pins 100 prevent cross-member 30 from free-falling downward along side members 18, 20.

If work piece 40 is replaced, after completion of one or more engagements of the work-piece-engaging member 58 with work piece 40, with a work piece having a different size, it may be necessary to relocate cross-member 30 relative to frame 12. Prior to relocating cross-member 30, retention member 180 can be connected to upper member 16 of frame 12 and cross-member 30 as shown in FIGS. 1, 7 and 8 and described previously. When pins 100 are removed, if required to relocate pins 100 on frame 12 to support cross-member 30 during operation of hydraulic press 10, retention member 180 provides a safety feature and prevents cross-member 30 from free-falling downward. The overall length of retention member 180 can be adjusted as required to permit moving cross-member 30 to a new location, for example if cross-member 30 is relocated downward from the position shown in FIG. 1. Retention member 180 can also be connected to upper member 16 and cross-member 30 during operation of hydraulic press 10 and/or when hydraulic press 10 is not in operation, even if cross-member 30 is not being relocated. Hydraulic press 10 can include one or more additional retention members 180 (not shown) that can be connected to the upper member 16 of frame 12 and the cross-member 30.

The presence of hand guards 210 prevents an operator from having his or her hands "pinched" in the spaces between beam 70 and side members 18 and 20, or in the spaces between beam 72 and side members 18 and 20 if cross-member 30 is relocated by grasping the bottom 34 of cross-member 30.

While the inventive principles have been illustrated by the description of various embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and methods and illustrative examples shown and described. Accordingly, departures may be made from such details without departing from the scope and spirit of the general inventive principles.

What is claimed is:

1. A hydraulic press comprising:

a frame comprising a base, an upper member positioned above the base and a pair of side members, the pair of side members being laterally spaced and extending upwardly from the base to the upper member;

a cross-member comprising a top and a bottom and extending between the pair of side members, the top of the cross-member being configured to support a work piece, the cross-member being moveable along the side members;

a strap connected to the upper member of the frame and the cross-member; and a pin comprising a handle, a tapered tip, an intermediate portion extending between the handle and the tapered tip, and a sheath secured to the intermediate portion proximate the handle; wherein the handle comprises a core portion and a grip surrounding the core portion;

the core portion of the handle, the tapered tip of the pin, and the intermediate portion of the pin comprise a unitary solid rod, the grip being made from an elastomeric material;

the pin engages a first one of the side members of the frame, the sheath contacting the first one of the side members of the frame; and the bottom of the cross-member engages the intermediate portion of the pin during operation of the hydraulic press.

2. The hydraulic press of claim 1, wherein:

the strap comprises an adjustable strap.

3. The hydraulic press of claim 2, wherein:

the adjustable strap comprises first and second flexible members and an adjustment device, the first flexible member being connected to the upper member of the frame and the adjustment device, the second flexible member being connected to the adjustment device and the cross-member.

4. The hydraulic press of claim 3, wherein:

the first and second flexible members are made from nylon webbing.

5. The hydraulic press of claim 2, wherein:

the adjustable strap comprises at least one flexible member made from a polymer.

6. The hydraulic press of claim 1, wherein:

the handle of the pin further comprises a shield integral with the grip and extending radially outwardly from the grip.

7. The hydraulic press of claim 1, wherein:

the first one of the side members of the frame comprises first and second end walls and at least one side wall extending between the first and second end walls;

the first one of the side members of the frame further comprises a first plurality of vertically spaced apertures extending through the first end wall and a second plurality of vertically spaced apertures extending through the second end wall, each of the first plurality of apertures being aligned with a respective one of the second plurality of apertures; and the pin extends through one of the first plurality of apertures and an aligned one of the second plurality of apertures.

8. The hydraulic press of claim 1, wherein:

the pin comprises a first pin and the hydraulic press further comprises a second pin, the second pin being engaged with a second one of the side members of the frame; and each of the first and second pins engages the bottom of the cross-member during operation of the hydraulic press.

9. The hydraulic press of claim 1, further comprising:

at least one hand guard secured to the cross-member at a location proximate one of the first one of the side members and a second one of the side members of the frame.

10. The hydraulic press of claim 9, wherein:

the hand guard comprises a first portion secured to the cross-member and a second portion integral with the first portion, the second portion being positioned below the cross-member.

11. The hydraulic press of claim 10, wherein:

each of the first and second ones of the side members of the frame comprises a front surface and a rear surface;

the cross-member comprises a first beam extending between the pair of side members of the frame, the first beam being positioned proximate the front surface of each of the first and second ones of the side members of the frame; and the cross-member further comprises a second beam extending between the pair of side members, the second beam being positioned proximate the rear surface of each of the first and second ones of the side members of the frame.

12. The hydraulic press of claim 11, wherein:

the cross-member further comprises at least two web members, each of the web members extending between and secured to the first and second beams;

a first one of the web members is positioned proximate the first one of the side members of the frame and a second one of the web members is positioned proximate the second one of the side members of the frame;

the first portion of each of the hand guards is secured to a respective one of the web members and the second portion of each of the hand guards is positioned below the first and second beams of the cross-member and extends beyond the front and rear surfaces of a respective one of the first and second ones of the side members of the frame.

13. A hydraulic press comprising:

a frame comprising a base, an upper member positioned above the base and a pair of side members, the pair of side members being laterally spaced and extending upwardly from the base to the upper member, each of the side members of the frame comprising a front surface and a rear surface;

a cross-member extending between the pair of side members, the cross-member being configured to support a work piece;

a retention member connected to the upper member and the cross-member; and a pin engaged with a first one of the side members of the frame and positioned below and in contacting engagement with the cross-member during operation of the hydraulic press the pin comprising a sheath; and a pair of hand guards, each of the hand guards comprising a first portion and a second portion integral with the first portion, the first portion of each of the hand guards being generally vertically oriented, the second portion of each of the hand guards being generally horizontally oriented; wherein the first portion of a first one of the hand guards is secured to the cross-member at a location proximate the first one of the side members of the frame, the first portion of a second one of the hand guards being secured to the cross-member at a location proximate a second one of the side members of the frame;

the second portion of the first one of the hand guards is positioned below the cross-member and is transverse to the first one of the side members of the frame, the second portion of the first one of the hand guards extending beyond the front surface and the rear surface of the first one of the side members of the frame; and the second portion of the second one of the hand guards is positioned below the cross-member and is transverse to the second one of the side members of the frame, the second portion of the second one of the hand guards extending beyond the front surface and the rear surface of the second one of the side members of the frame.

14. The hydraulic press of claim 13, wherein:

the retention member comprises an adjustable strap.

15. The hydraulic press of claim 14, wherein:

the pin further comprises a handle, a tapered tip and an intermediate portion extending between the handle and the tapered tip.

16. The hydraulic press of claim 15, wherein:

the handle comprises a core portion and a grip surrounding the core portion; and the core portion of the handle, the tapered tip of the pin and the intermediate portion of the pin comprise a unitary solid rod, the grip of the handle being made from an elastomeric material.

17. The hydraulic press of claim 6, wherein:

the cross-member further comprises a first beam, a second beam and at least one web extending between and secured to the first beam and the second beam; and the sheath comprises a length and the first beam comprises a width, the length of the sheath being greater than the width of the first beam such that the shield of the handle is spaced apart from the first beam when the sheath contacts the first one of the side members of the frame.

18. The hydraulic press of claim 17, wherein:

the first beam of the cross-member comprises a rear surface;

the first one of the side members of the frame comprises a front end wall, the front end wall comprising a front surface; and the sheath contacts the front surface of the front end wall, the rear surface of the first beam of the cross-member being proximate the front surface of the front end wall.

19. The hydraulic press of claim 7, wherein:

the intermediate portion of the pin and the sheath of the pin are sized to prevent the sheath from passing through the one of the first plurality of apertures and the aligned one of the second plurality of apertures, the sheath functioning as an over-insertion stopper.

20. The hydraulic press of claim 13, wherein:

the cross-member comprises a first beam and a second beam, each of the first beam and the second beam extending between the pair of side members of the frame, the first beam being positioned proximate the front surface of each of the first and second ones of the side members of the frame; and the second beam is positioned proximate the rear surface of each of the first and second ones of the side members of the frame.

21. The hydraulic press of claim 20, wherein:

the cross-member further comprises at least two web members, a first one of the web members being positioned proximate the first one of the side members of the frame, a second one of the web members being positioned proximate the second one of the side members of the frame; and the first portion of the first one of the hand guards is secured to the first one of the web members and the first portion of the second one of the hand guards is secured to the second one of the web members.

* * * * *